US007856936B2

(12) United States Patent
Nemethy

(10) Patent No.: US 7,856,936 B2
(45) Date of Patent: Dec. 28, 2010

(54) LIFT LOCK SECURITY SYSTEM

(76) Inventor: Peter Nemethy, 12650 7th St. East, Treasure Island, FL (US) 33706

( * ) Notice: Subject to any disclaimer, the term of this patent is extended or adjusted under 35 U.S.C. 154(b) by 209 days.

(21) Appl. No.: 12/352,630

(22) Filed: Jan. 13, 2009

(65) Prior Publication Data

US 2010/0107950 A1 May 6, 2010

Related U.S. Application Data

(60) Provisional application No. 61/111,005, filed on Nov. 4, 2008.

(51) Int. Cl.
*B63C 7/00* (2006.01)

(52) U.S. Cl. ..... 114/44; 405/3

(58) Field of Classification Search ..... 114/44, 114/45, 48, 49; 70/57, 58; 405/3, 4, 5, 6, 405/7

See application file for complete search history.

(56) References Cited

U.S. PATENT DOCUMENTS 5,769,568 A * 6/1998 Parkins et al. ..... 405/3
5,988,941 A * 11/1999 Sargent et al. ..... 405/3
6,230,639 B1 * 5/2001 McLaughlin et al. ..... 114/44
6,904,857 B1 * 6/2005 Holden ..... 405/3
6,918,345 B2 * 7/2005 Golden et al. ..... 114/44
7,117,805 B2 * 10/2006 Shackelford, Jr. ..... 114/44
7,383,781 B1 * 6/2008 Griffin ..... 114/44
7,765,945 B2 * 8/2010 Radcliff ..... 114/44

* cited by examiner

*Primary Examiner*—Lars A Olson
(74) *Attorney, Agent, or Firm*—Dennis G. LaPointe

(57) ABSTRACT

An anti-theft security system for boats on boat lifts, which also provides for stability to eliminate boat swaying on the lift during wind storms. The system includes two opposing secondary side rails configured to move laterally along an underside of the primary boat lift I-beams. The side rails are interlocked within receiving brackets mounted to the boat lift posts, using a locking device that locks one of the side rails to the post mounted brackets on the dock pier side. The opposite secondary side rail includes an attached pull bar that allows a person to place the rail in position for locking or to pull the opposite side rail away from the lift posts to lower the boat into the water. The pull bar handle is interlocked with the rail nearest the dock pier side.

6 Claims, 11 Drawing Sheets

LIFT LOCK SECURITY SYSTEM

RELATED APPLICATION

This application claims the benefit of provisional patent application Ser. No. 61/111,005 filed Nov. 4, 2008.

FIELD OF THE INVENTION

The invention relates to an anti-theft security system for boats on boat lifts, which also provides for stability to eliminate boat swaying on the lift during wind storms.

BACKGROUND OF THE INVENTION

There has been an increased amount of boat thefts along the coast of the Gulf of Mexico. Most thefts involve boats capable of moving at high speeds and the thefts involve drug runners who immediately take the stolen boats to Mexico for use by the drug runners. They look for boats with three outboard motors or high speed inboard boats that can run away from the Coast Guard.

What is needed is a system for locking down the boats on the lifts as a deterrence.

SUMMARY OF THE INVENTION

The present invention is a system that is incorporated into the structure of an existing boat lift. The boat is placed onto the lift in the usual manner. It is then secured in place using the present invention. The boat is still lifted up by cables but rests on brackets for stability and security.

The brackets comprising the present invention can be placed on several levels; for daily use and for storm safety. Even with heavy winds, the boat will not rock or sway as with cables alone, the brackets secure its position.

Even if a thief cuts the cables, the boat will not fall into the water, as the brackets will hold it in place. The locking mechanism is configured to make it difficult to cut since there is interference provided for in the design of the structural components of the invention. Hence the only way to release the boat is to open or break the lock and lower the boat.

In general, the invention is a boat lift security and locking system incorporated into a boat lift system that includes a plurality of parallel boat lift upright support members and is configured with boat hull cradle members and parallel spaced-apart transverse primary support members that are lifted to raise and lower the boat to and from the water, the boat lift security and locking system comprising:

two longitudinal spaced-apart secondary support members, the secondary support members having means for movably engaging the spaced-apart transverse primary support members so as to move each of the secondary support members in an inward and outward direction while in an underlying relationship with the spaced-apart transverse primary support members;

a pull bar attached to one of said secondary support members having a length sufficient to be handled from a dock, the pull bar serving as means for manipulating the inward and outward motion of the secondary support member furthest away from the dock edge;

means for seating or resting the two longitudinal spaced-apart support members in place when the boat is stored on said boat lift system; and means for securing and locking one of the two longitudinal spaced-apart support members to the means for seating the two longitudinal spaced-apart support members.

The means for movably engaging the spaced-apart transverse primary support members so as to move each of the secondary support members in an inward and outward direction while in an underlying relationship with said spaced-apart transverse primary support members comprises two spaced-apart brackets coupling each of the secondary support members to a lower flange portion of a respective transverse primary support member, the brackets further having rollers configured to roll along an upper surface of the lower flange portion.

The system further comprises means for preventing an over-travel of the rollers and its coupled secondary support members more than a predetermined distance from each respective side of the upright support members.

The system further comprises means for securing and locking the pull bar to a respective opposing secondary support member so that the parallel secondary support members remain in a non-interference position with a lowering or raising of the boat lift system.

The means for seating the two longitudinal spaced-apart support members when the boat is stored on the boat lift system comprises a bracket secured to two or more upright support members on each side of the boat lift system, each bracket being configured such that bracket fasteners can not be removed when the secondary support members are engaged in the brackets.

The means for securing and locking one of the two longitudinal spaced-apart support members to the means for seating the two longitudinal spaced-apart support members when the boat is stored on the boat lift system and to one of the upright support members comprises a lock system having a first component configured to be an elongate members insertable through an underside opening of at least one of the brackets secured to two or more upright support members through the secondary support member and configured to further extend above the secondary support member for engagement of a mating locking coupler component.

BRIEF DESCRIPTION OF THE DRAWINGS

In the accompanying drawings.

DETAILED DESCRIPTION OF THE INVENTION

Figure 1:
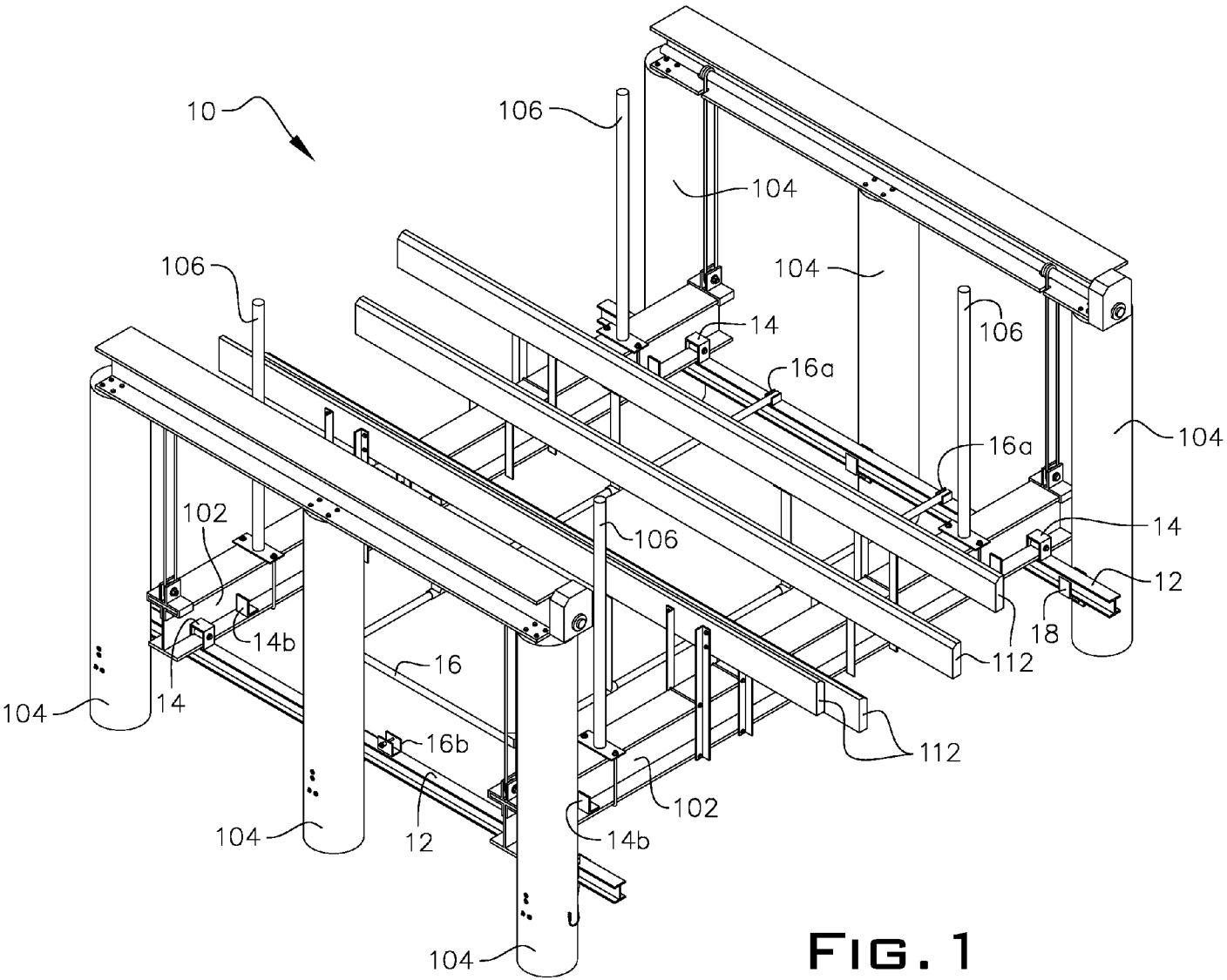
FIG. 1 shows a top front left isometric view of the compete assembly in a locked down rested position.
Figure 2:
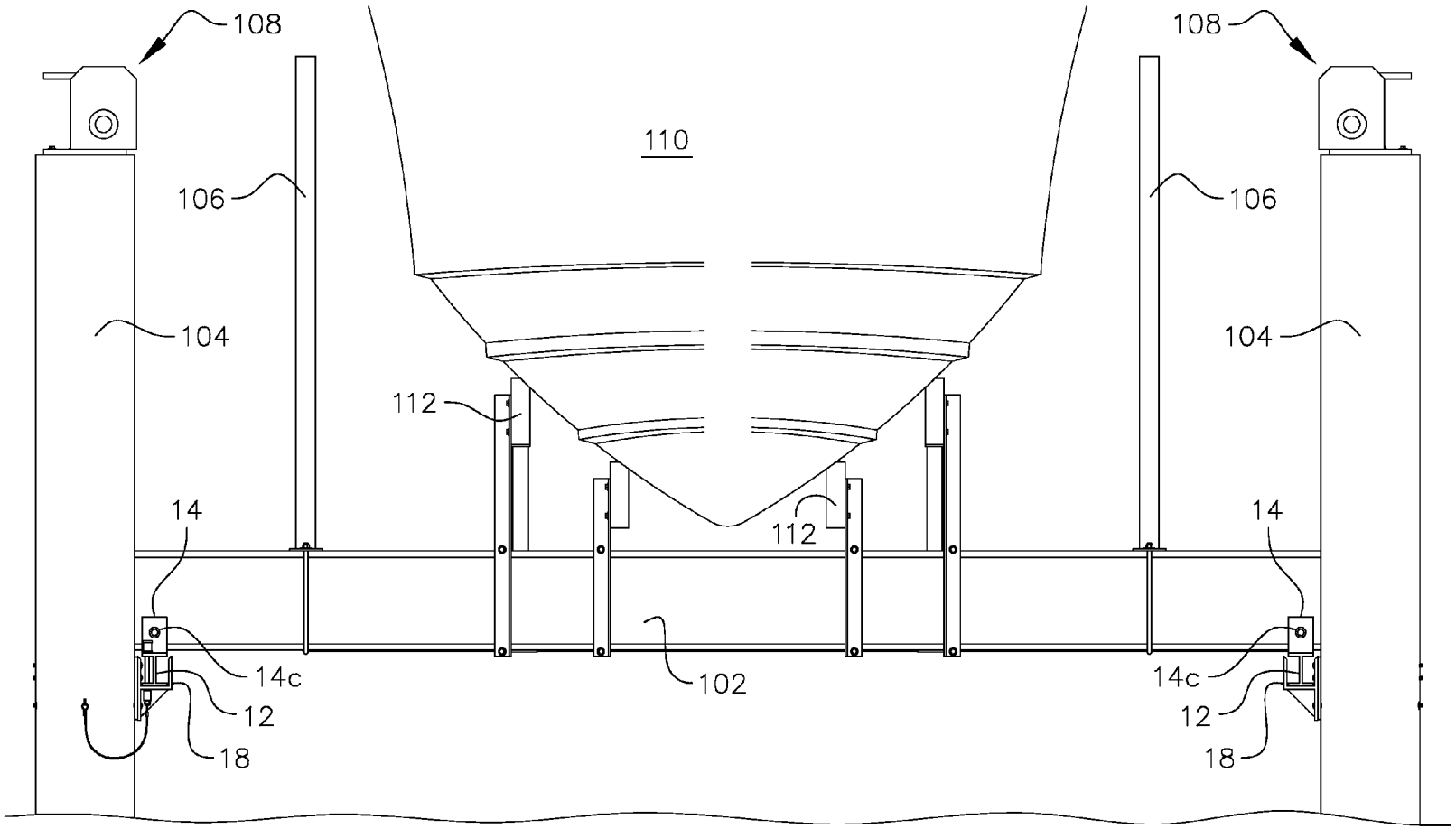
FIG. 2 shows a front view of FIG. 1 with a portion of a boat shown.
Figure 3:
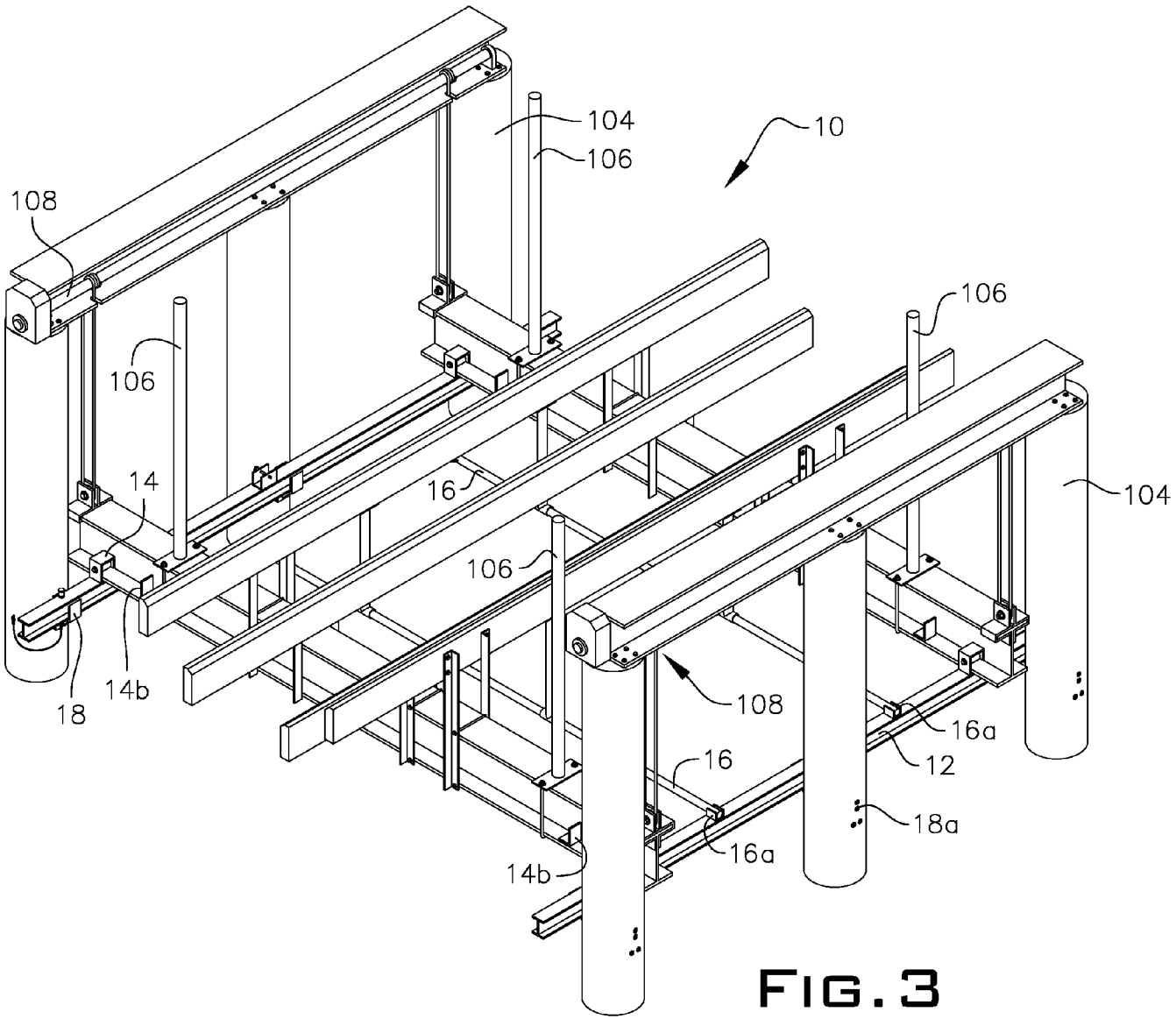
FIG. 3 shows a top front right isometric view of the compete assembly in a locked down rested position.
Figure 4:
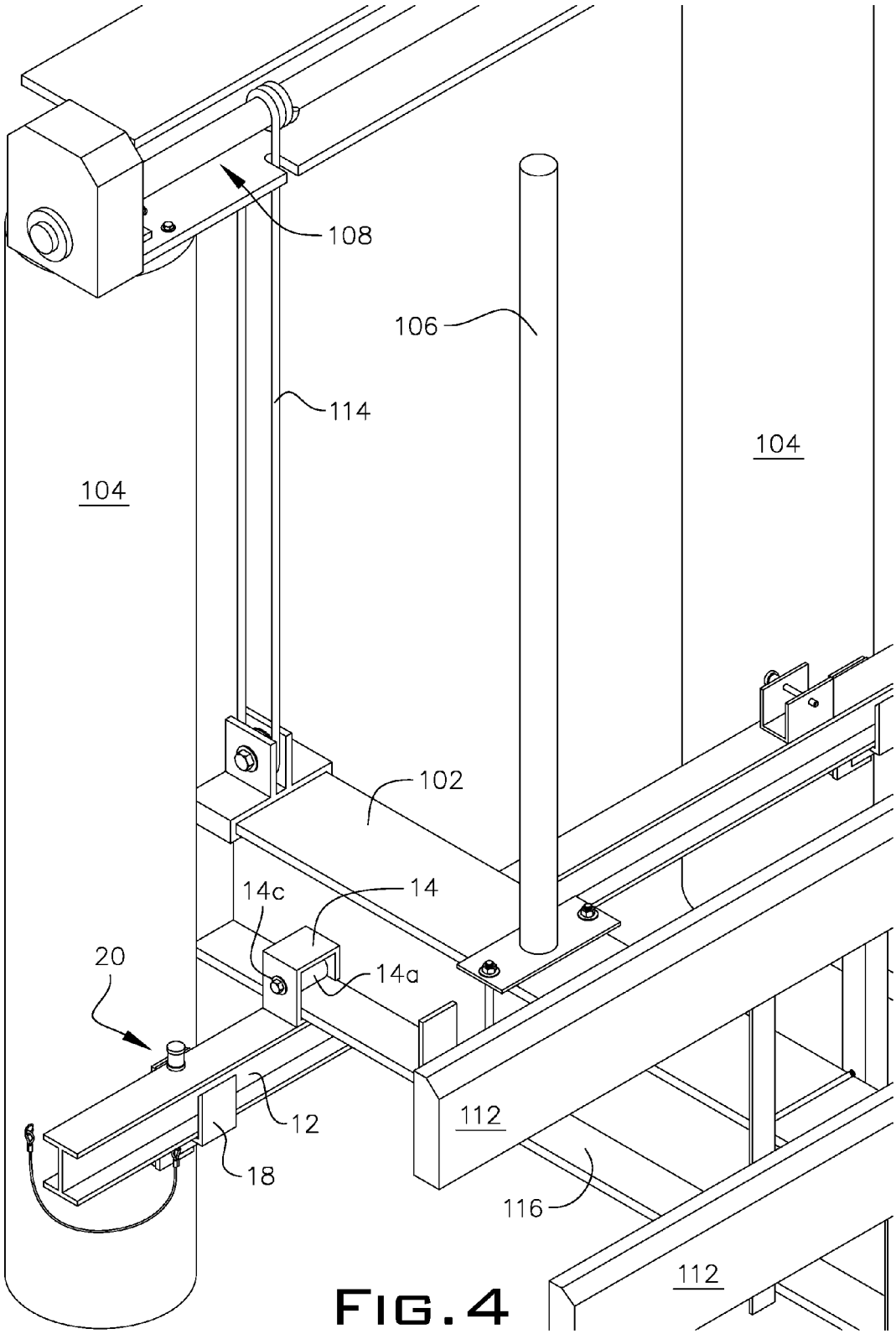
FIG. 4 shows a close up of the left corner portion from FIG. 3.
Figure 5:
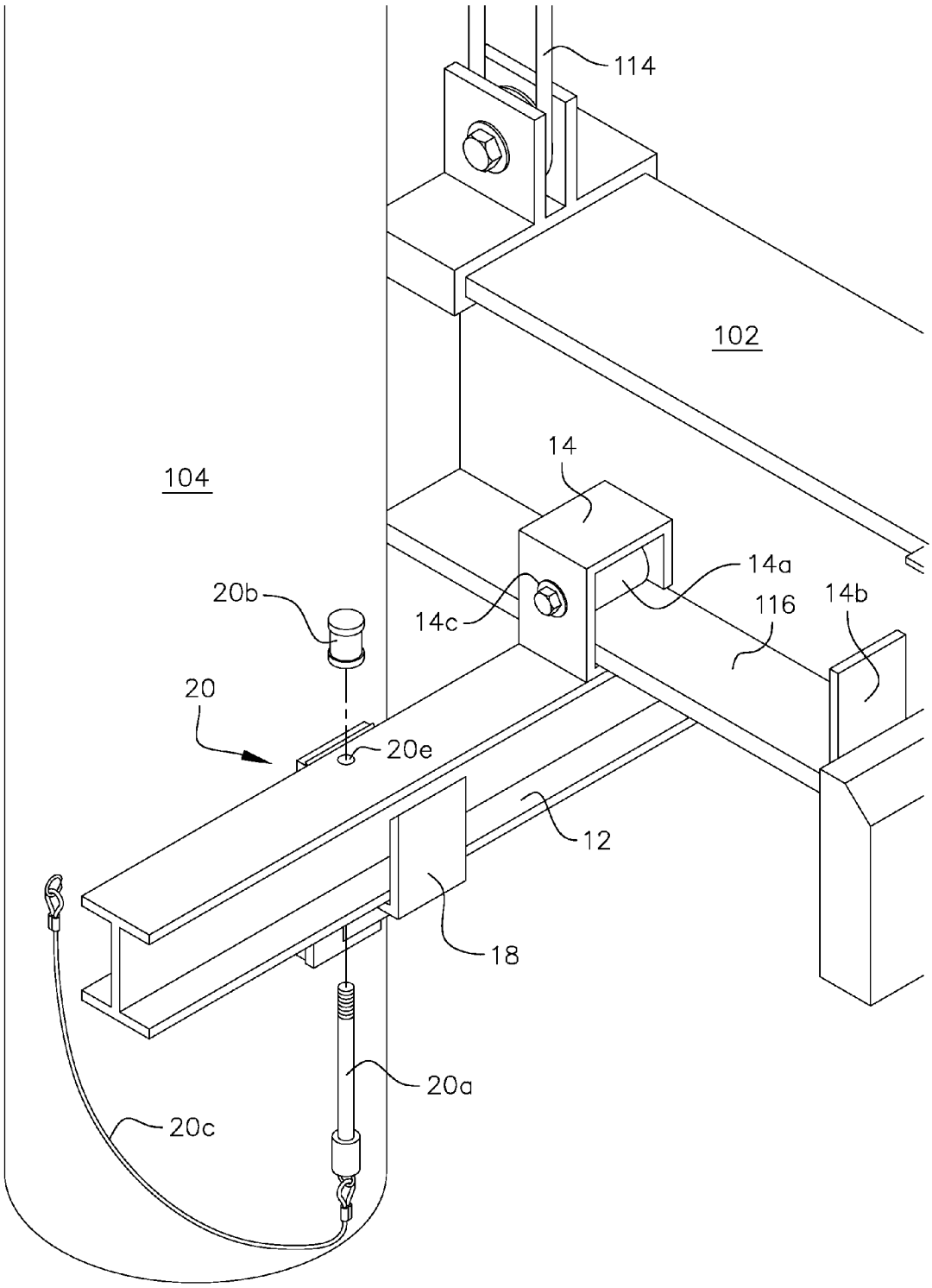
FIG. 5 shows the lock being removed or exploded view of the locking mechanism.
Figure 6:
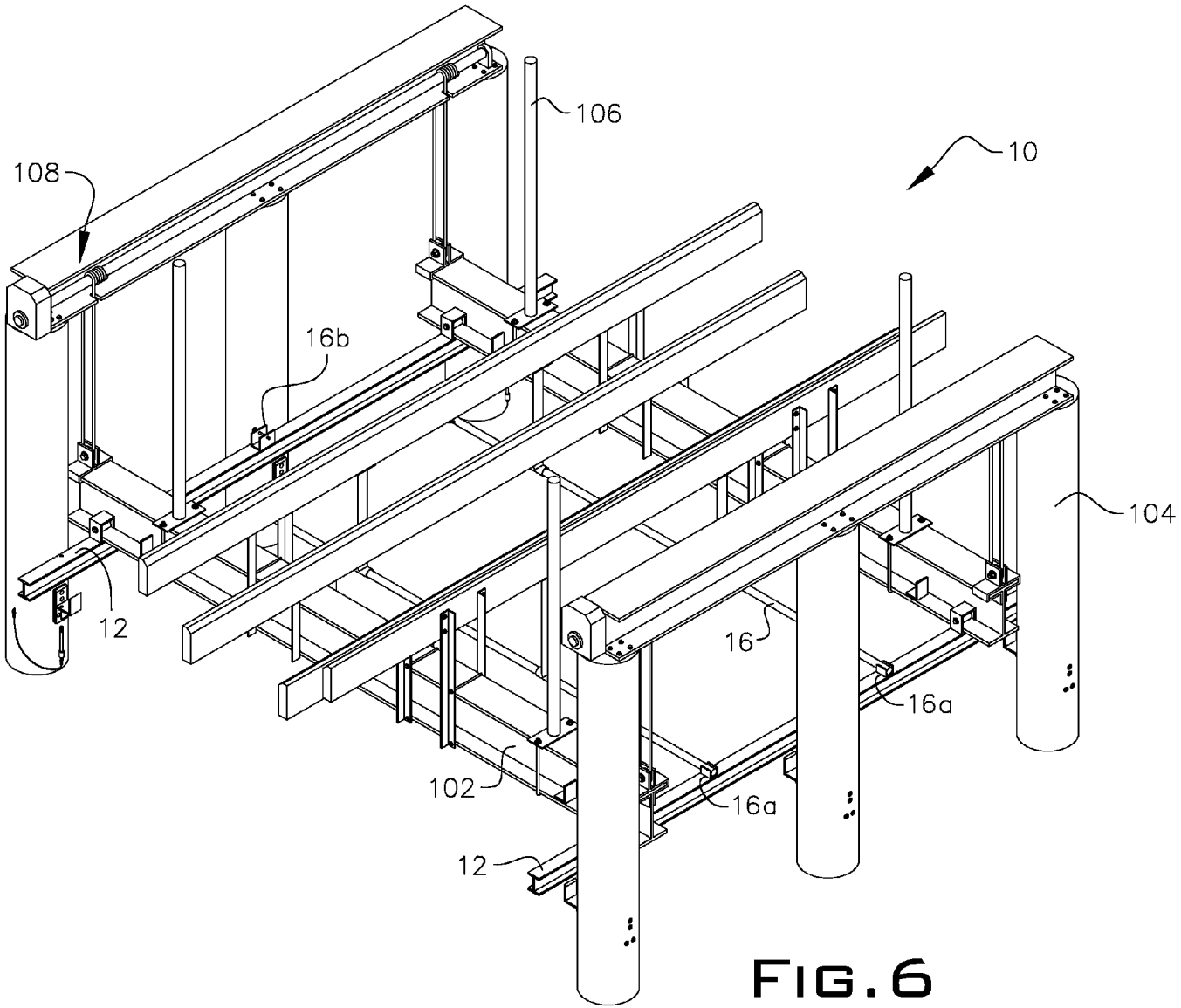
FIG. 6 shows a top front right isometric view of the complete assembly in an unlocked & raised position.
Figure 7:
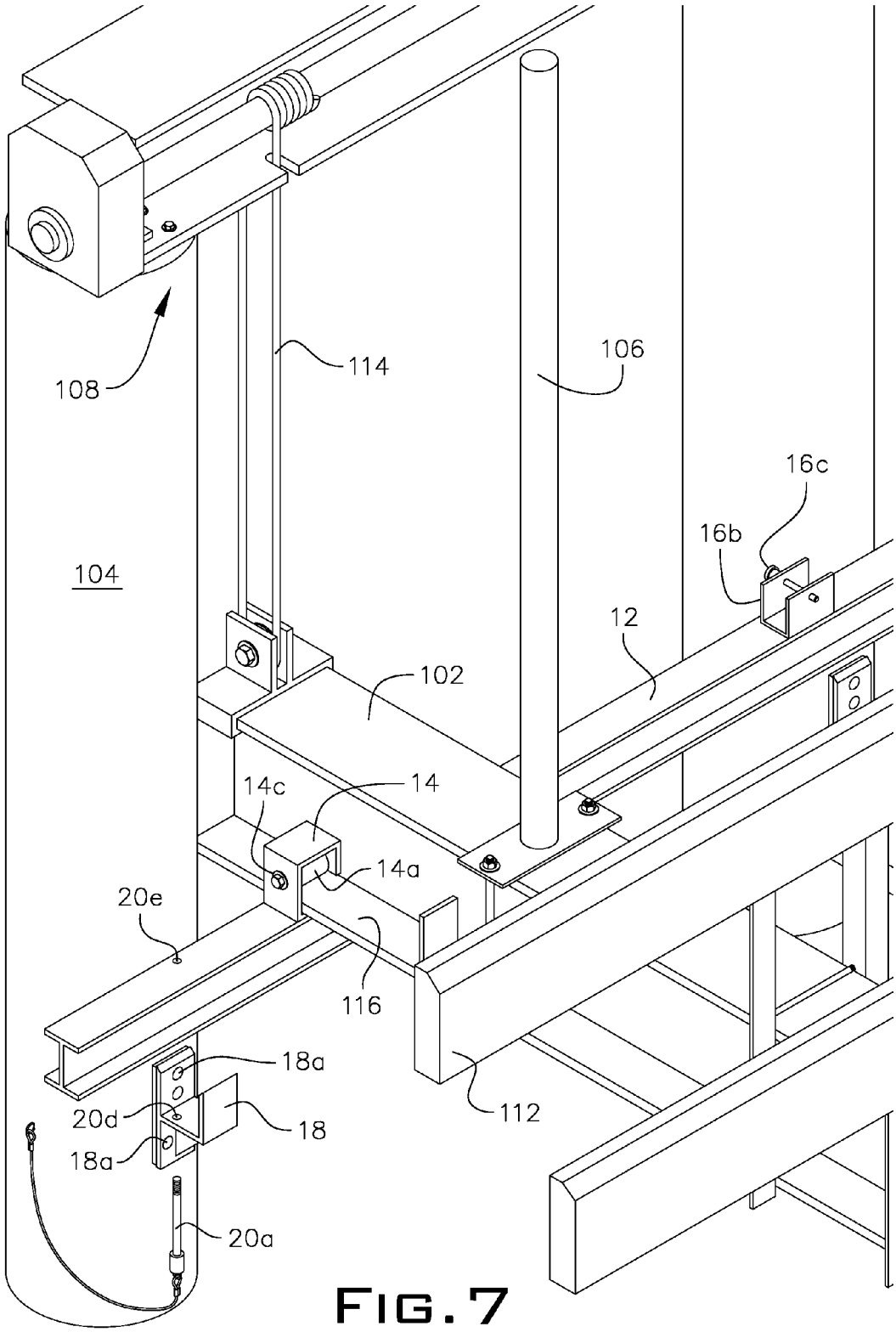
FIG. 7 shows a close up of a portion of FIG. 6.
Figure 8:
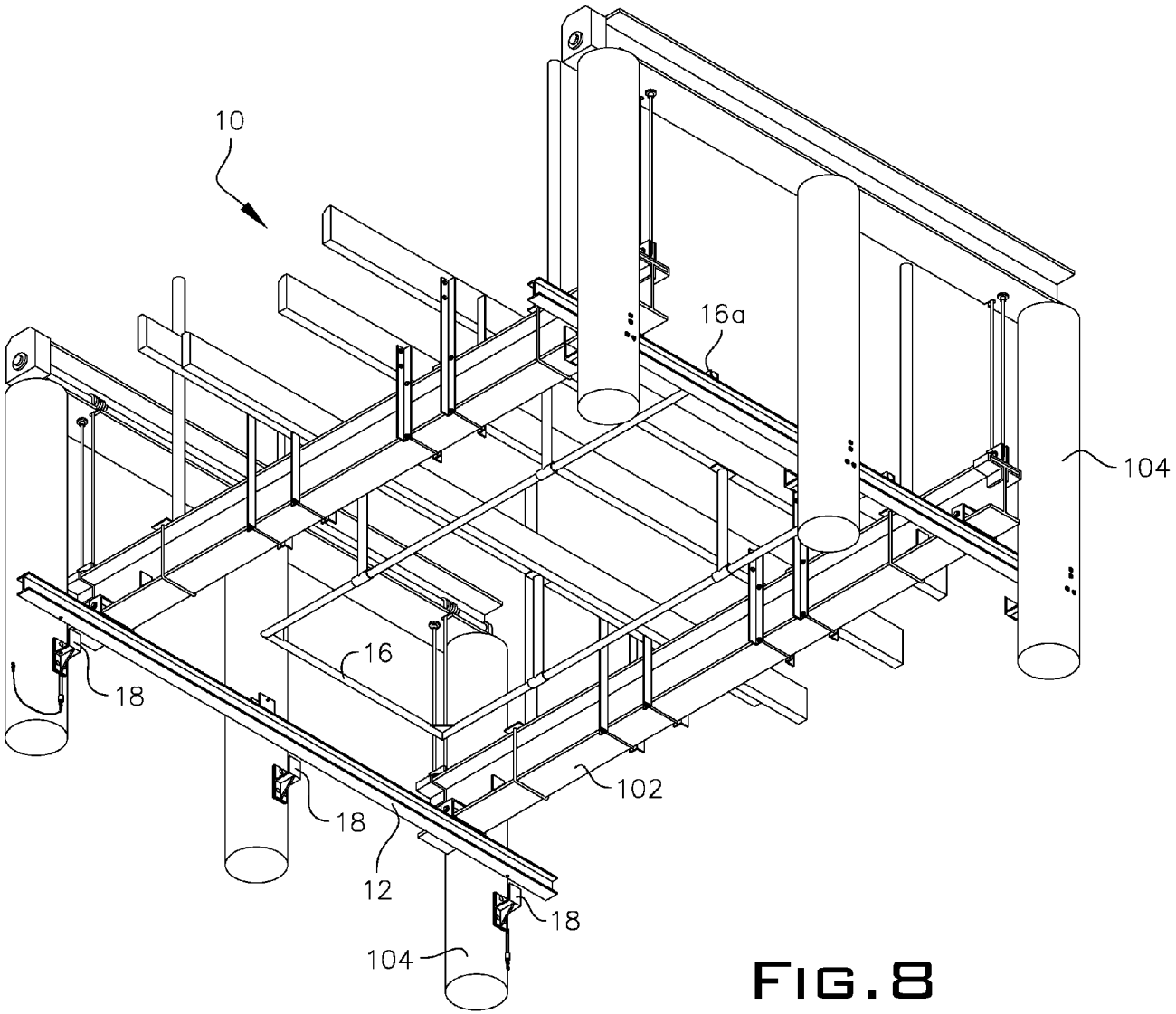
FIG. 8 shows a bottom front right isometric view of the compete assembly in an unlocked & raised position.
Figure 9:
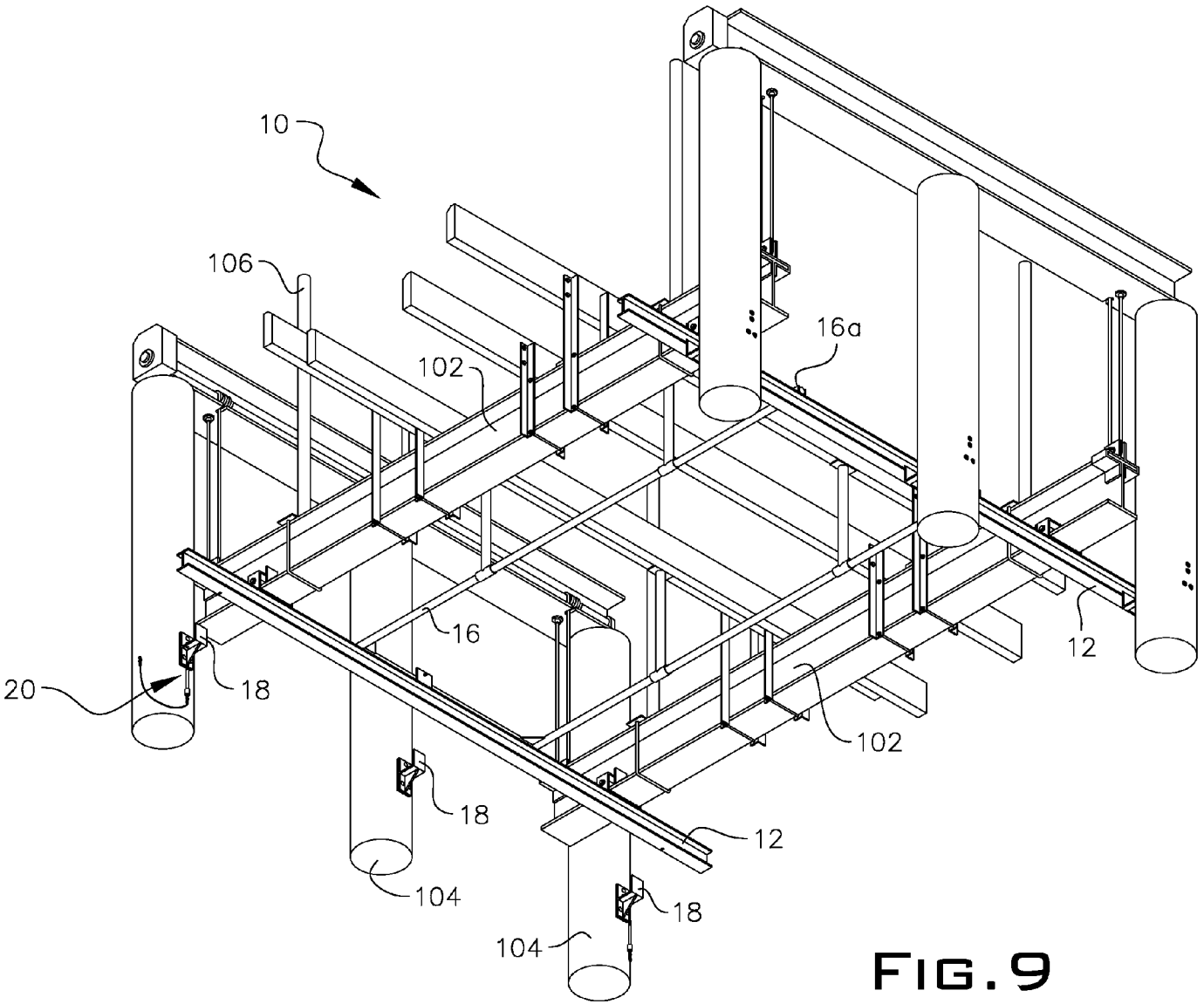
FIG. 9 shows a bottom front right isometric view of the compete assembly with the lower supports or secondary support member rolled inwardly and locked in place using the pull bar lock and the roller stops.
Figure 10:
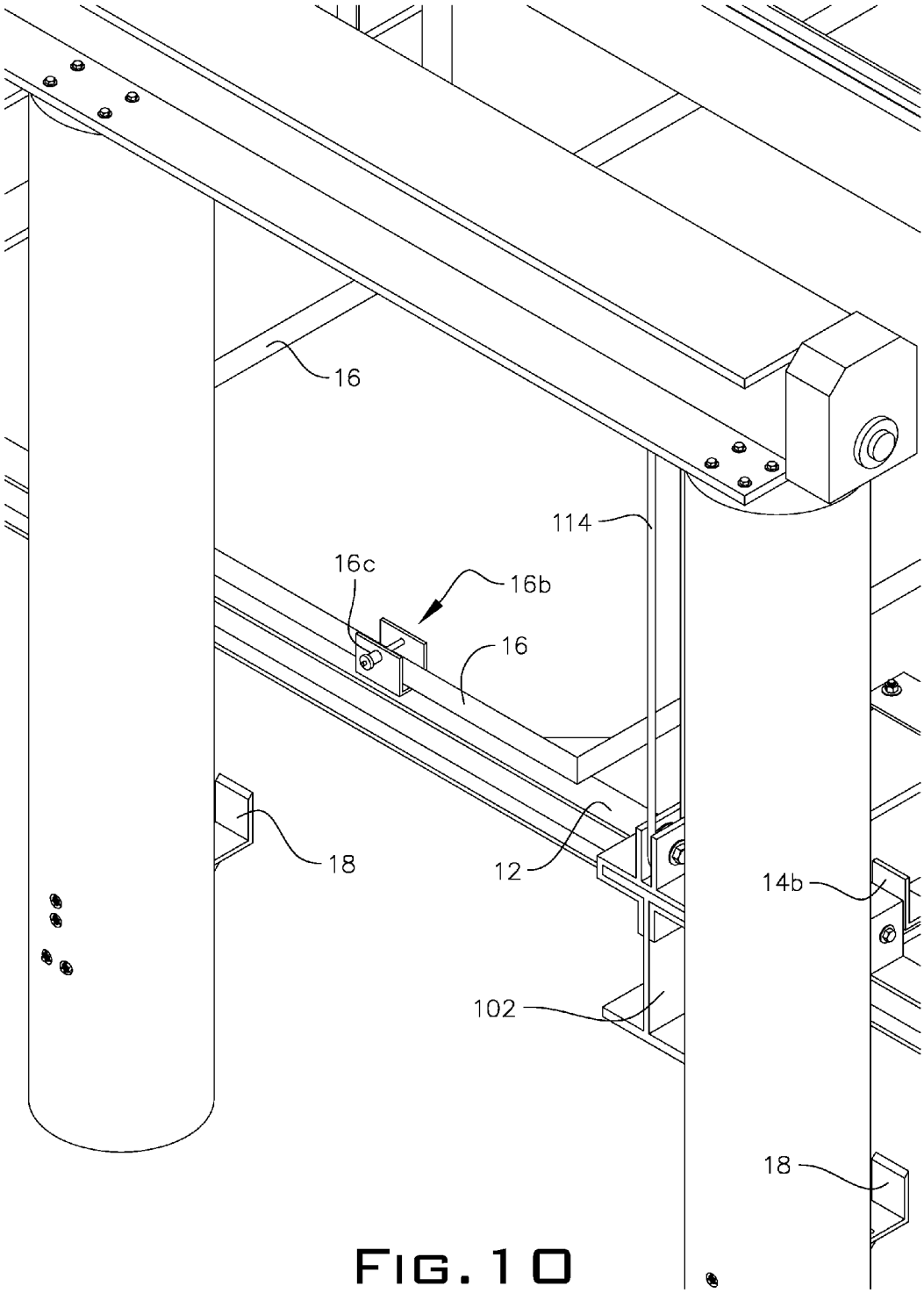
FIG. 10 shows a close up of a top front left isometric view to show lower supports locking method, in particular, the pull bar arm engaged within a U-shaped channel member.
Figure 11:
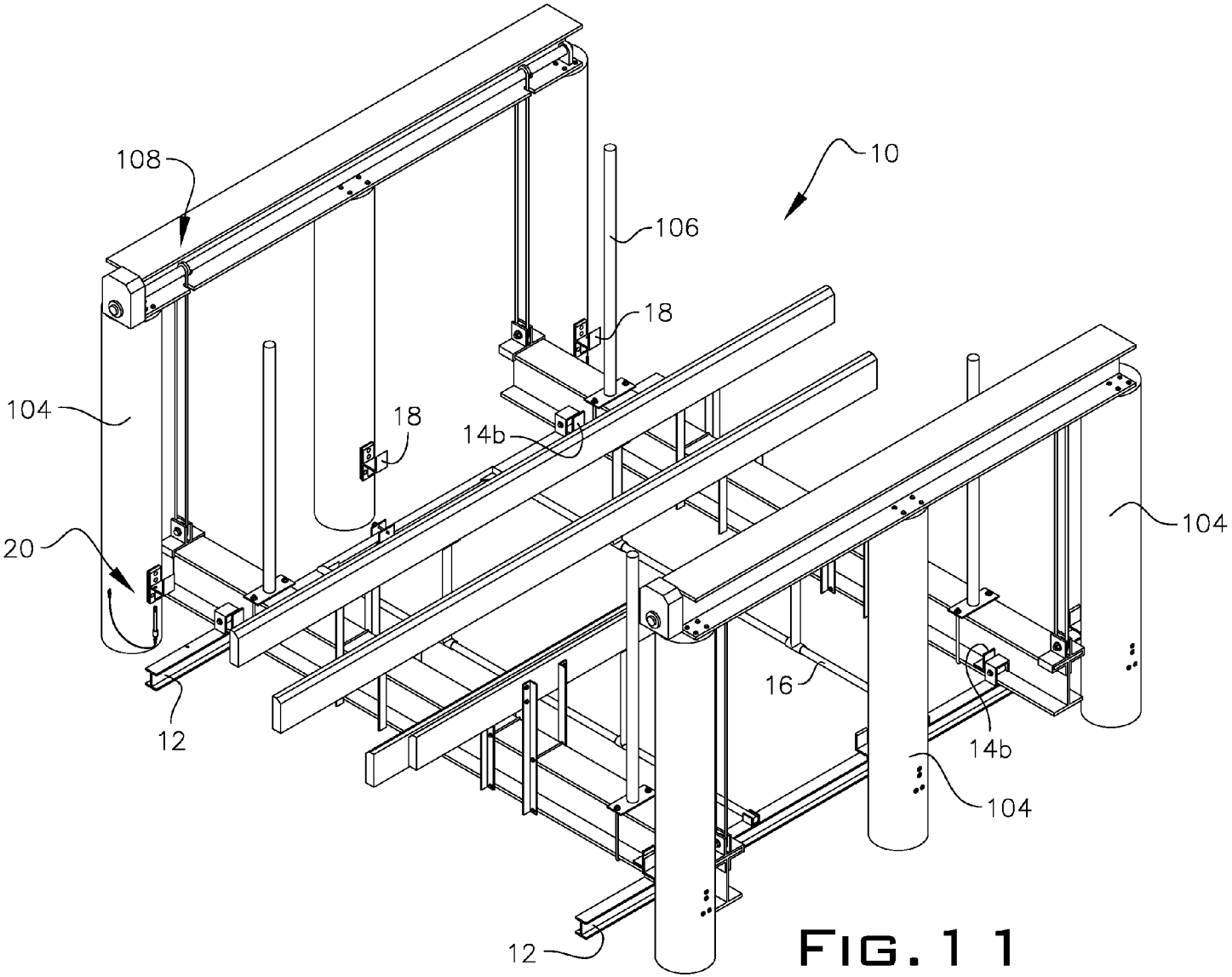
FIG. 11 shows a top front right isometric view of the compete assembly in a completely lowered position, allowing a boat to docked or undocked.

Referring now to the drawings, FIGS. 1-11 disclose a representative example of one embodiment of the present invention, which is a boat lift locking system to prevent boat thefts and to provide for stability of the boat on the lift during high winds. All roller mechanisms, locking methods and structural support members shown are intended to be representative of several equivalent structures that could be used. For example, structure members could be I-beams, or other structural forms used in industry, including channel members, angle iron, etc. Rollers could be replaced with other equivalent ways of moving the secondary support members along the primary support members including sliding type mechanisms, belts and pulley systems, etc. The drawings are only intended to show on example of how to construct the present invention.

For aid in identifying the components of a typical boat dock lift and the components of the present invention used with a boat lift, the following enumerated parts from one example of the invention which is depicted in the drawings are listed:

10—the invention as generally depicted;

12—secondary support members/longitudinal spaced-apart side rails;

14—brackets to slidingly or rollingly couple members 12 to members 102;

14*a*—rollers;

14*b*—roller stops;

16—pull bar assembly;

16*a*—attachment points to side rails 12;

16*b*—pull bar locking or securement means shown as U-shaped bracket attached to side rail 12 closest to dockside and removable pull pin 16*c* insertable after handle of U-shaped pull bar is placed in bracket 16*b;*

16*c*—removable locking pull pin for U-shaped pull bar 16;

18—brackets mounted to inside of upright supports and configured to receive/engage respective side rails 12, which are lowered and positioned within the brackets 18;

18*a*—bolts for fastening brackets 18 to upright supports 104;

20—primary or main locking mechanism;

20*a*—locking mechanism pin;

20*b*—mating lock that engages with pin 20*a;*

20*c*—lanyard for pin 20*a* so pin is not dropped in water;

20*d*—bracket 18 hole for insertion of pin 20*a;*

20*e*—holes in rail 12 for pin 20*a;*

102—primary support members, depicted as two spaced-apart transverse I-beams (these are typically part of a standard boat lift system;

104—dock piling/upright support members (can be timber pilings or structural steel or aluminum forms);

106—boat guide poles;

108—motorized or mechanical operated boat lift cable system typical of most lift systems;

110—boat;

112—boat hull cradle support members or bunk;

114—boat lift cables;

116—lower flanges of support members 102;

In the example given, the drawings depict two longitudinal spaced-apart side rails or secondary support members 12, in the example formed by I-beams, which are bracketed to the boat lift transverse I-beams or primary support members 102. In the example provided, the lower flanges 116 of the support members 102 are used. Depending on the support member 102 shape, there are several means for providing the bracketing. When an I-beam configuration is used for member 102, the brackets are typically configured so as to provide means for inward and outward (or transverse) travel of the secondary support members 12 while in an underlying relationship to the spaced-apart transverse primary support members 102. In the drawing example, rollers 14*a* are incorporated into brackets 14 configured to couple the secondary support members 12 with the primary support members 102 wherein the rollers 14*a* are able to roll on the top surfaces (both sides of I-beam) of each lower flange 116 of the primary support members 102 and to allow the secondary side rails 12 to travel laterally along the lower primary lift I-beam flanges 116 in an underlying relationship to the primary lift I-beams 102. In a preferred embodiment, roller stops 14*b* are placed on the flange surface 116 nearest the dockside so that the side rail 12 nearest the dockside can not be pushed or rolled to the point where it would be difficult to reach the rail 12 to bring it back for locking with the upright supports 104 on the dockside. There are several means for preventing an over-travel of the rollers 14*a* more than a predetermined distance from each side of the upright supports 104. One simple illustration is to provide an angled form or plate that serves as a stopping mechanism. The bracket 14 itself is typically fastened to secondary support members 12 and extend vertically to effective wrap around the lower flanges 116 of the I-beam 102 with the rollers 14*a* configured to roll about an axis pin 14*c* along the top surface of the lower flanges 116.

The opposite side rail 12 or rail the furthest away from someone standing at the dockside pier, has a pull bar assembly 16 (shaped in the drawings as U-shaped but need not be) attached to it such that someone standing on the dock can grab the pull bar assembly handle and laterally maneuver the opposite side rail in position for docking and locking the boat or away from the opposite lift posts to drop the boat into the water. The pull bar handle (common leg of U-shaped pull bar in drawings but could be transverse bar if formed as a single arm) is configured to be locked or otherwise secured into a U-shaped channel bracket equipped with a pull pin 16*c* mounted on top of the near side rail 12 so that the opposite rail and near rail are effectively interlocked together. The U-shaped channel depicted assumes an engagement with a pull bar that is U-shaped with a common leg, however, a single transverse arm shaped pull bar could engage in a similar U-shaped channel that is rotated 90 degrees. The travel across the underside of the primary lift I-beams can be limited by the U-bolts that tie in the PVC vertically mounted spaced-apart boat guides 106 that extend upward from the top surface of the primary lift I-beams 102. The pin 16*c* can be attached to a lanyard or cable that has a remote end attached to the dock or dock post. The lanyard is not shown in the drawings. The ends of the spaced-apart legs of the pull bar assembly 16 are attached to the side rail 12 furthest away from the dockside pier/dock (see attachment points 16*a*). As mentioned above, the pull bar 16 can be a straight bar with a single attachment point 16*a* to the far side rail 12. However, in a preferred embodiment, the pull bar 16 is U-shaped as illustrated. Further, the means for securing and locking said pull bar to a respective opposing secondary support member so that the parallel secondary support members remain in a non-interference position with a lowering or raising of said boat lift system can be in the form of the U-shaped channel discussed above with a pull pin that secures the bar component within the channel or other methods could be used such as an aperture in the pull bar component and the rail with an inserted pin through both or a clip into which the pull bar component snaps into or any other equivalent method. These methods and others are well known in the art and can easily be adapted as a matter of design choice.

When a boat 110 is lifted for docking at the pier, the pull bar 16 is unlocked or otherwise freed from the bracket 16*b* and the handle portion is pushed adjacent the upright supports

104, and the nearest side rail 12 is pulled adjacent the upright supports 104 closest to the dockside pier/dock. The lift assembly 108 can be activated mechanically or electrically using a motors and is used to lower the lift until the respective side rails 12 drop into brackets 18. It is preferable that at least two spaced-apart brackets 18 be used on the upright support 104. The upper side of each bracket is essentially L-shaped or U-shaped when coupled to each upright support 104. In the drawings, three upright supports 104 on each side of the lift assembly are illustrated and a bracket 18 is installed on each member 104. If the upright supports are metallic, then brackets 18 can be welded or bolted or if the supports 104 are wooden pilings, then long bolts 18*a* or lag screws can be used as illustrated.

The brackets 18 are the primary components of the main or primary locking mechanism 20. There are several means for locking the side rails 12 to the dockside upright members 104 using brackets 18. The brackets 18 themselves can not be removed when the side rails 12 are engaged with brackets 18 as the fastening bolts 18*a* are inserted first and can not be backed out without lifting the side rails 12. Only one locking mechanism 20 is needed at one of the brackets 18 on one of the pier/dock side upright members 104. A standard lock coupled to the bracket 18 and side rail 12 may be useful. However, in a preferred embodiment, the locking mechanism 20 is designed so that a thief has difficulty cutting or breaking the lock due to interferences.

Certainly, the lock components can be made from a hardened steel material such as those used on automobile steering wheel locking bars or trailer hitch locks, that is, material that is hard and time-consuming to cut, if at all. A preferred method of providing means for locking the boat 110 to the pier uprights 104 is to incorporate a pin 20*a* that is attached to the upright member 104 by a lanyard 20*c*. Although lanyard 20*c* is not needed, it is a great convenience item to prevent pin 20*a* from being dropped in the water. Pin 20*a* is insertable through a hole 20*d* in the bottom of the bracket 18 through holes 20*e* (upper hole shown in FIGS. 5 and 7, lower hole not visible from view shown but understood to be present) in both the upper and lower flanges of side rail 12. Holes 20*e* are preferably located so that the pin 20*a* passes between the center I-portion of the rail 12 and the upright support 104. A mating lock portion or coupler 20*b* then engages the protruding portion of the pin 20*a* that extends above the surface of the rail 12.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention.

I claim:

1. A boat lift security and locking system incorporated into a boat lift system that includes a plurality of parallel boat lift upright support members and is configured with boat hull cradle members and parallel spaced-apart transverse primary support members that are lifted to raise and lower a boat to and from the water, the boat lift security and locking system comprising:

two longitudinal spaced-apart secondary support members, said secondary support members having means for movably engaging said spaced-apart transverse primary support members so as to move each of said secondary support members in an inward and outward direction while in an underlying relationship with said spaced-apart transverse primary support members;

a pull bar attached to one of said secondary support members having a length sufficient to be handled from a dock, said pull bar serving as means for manipulating the inward and outward motion of said one of said secondary support members;

means for seating said two longitudinal spaced-apart support members when said boat is stored on said boat lift system; and means for securing and locking one of said two longitudinal spaced-apart support members to said means for seating said two longitudinal spaced-apart support members when said boat is stored on said boat lift system and to one of said upright support members.

2. The system according to claim 1, wherein the means for movably engaging said spaced-apart transverse primary support members so as to move each of said secondary support members in an inward and outward direction while in an underlying relationship with said spaced-apart transverse primary support members comprises:

two spaced-apart brackets coupling each of said secondary support members to a lower flange portion of a respective transverse primary support member, said brackets further having rollers configured to roll along an upper surface of said lower flange portion.

3. The system according to claim 2, further comprising:

means for preventing an over-travel of the rollers and its coupled secondary support members more than a predetermined distance from each respective side of said upright support members.

4. The system according to claim 1, further comprising:

means for securing and locking said pull bar to a respective opposing secondary support member so that said parallel secondary support members remain in a non-interference position with a lowering or raising of said boat lift system.

5. The system according to claim 1, wherein said means for seating said two longitudinal spaced-apart support members when said boat is stored on said boat lift system comprises:

a bracket secured to two or more upright support members on each side of said boat lift system, each bracket being configured such that fasteners can not be removed when said secondary support members are engaged in said brackets.

6. The system according to claim 5, wherein said means for securing and locking one of said two longitudinal spaced-apart support members to said means for seating said two longitudinal spaced-apart support members when said boat is stored on said boat lift system and to one of said upright support members comprises:

a lock system having a first component configured to be an elongate member insertable through an underside opening of at least one of said brackets secured to two or more upright support members on each side of said boat lift system through said secondary support member and configured to further extend above said secondary support member for engagement of a mating locking coupler component.

* * * * *